US010701496B2

(12) United States Patent
Marcher et al.

(10) Patent No.: US 10,701,496 B2
(45) **Date of Patent: *Jun. 30, 2020**

(54) FLEXIBLE EAR TIP FOR A HEARING AID

(71) Applicant: Widex A/S, Lynge (DK)

(72) Inventors: Ib Marcher, Herlev (DK); Kasper Holkved Rasmussen, Bronshoj (DK)

(73) Assignee: Widex A/S, Lynge (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/006,276

(22) Filed: Jun. 12, 2018

(65) Prior Publication Data

US 2018/0367926 A1 Dec. 20, 2018

Related U.S. Application Data

(60) Provisional application No. 62/520,772, filed on Jun. 16, 2017.

(51) Int. Cl.
*H04R 25/00* (2006.01)
*H04R 1/10* (2006.01)

(52) U.S. Cl.
CPC ..... *H04R 25/652* (2013.01); *H04R 1/1016* (2013.01); *H04R 25/656* (2013.01); *H04R 25/654* (2013.01); *H04R 2225/025* (2013.01); *H04R 2460/11* (2013.01)

(58) Field of Classification Search
CPC .. H04R 25/652; H04R 25/656; H04R 1/1016; H04R 2223/025; H04R 2460/11; H04R 25/654
USPC ..... 381/328, 324, 525, 327, 338, 330, 381; 379/430
See application file for complete search history.

(56) References Cited

U.S. PATENT DOCUMENTS

| | | | | |
|---|---|---|---|---|
| 3,935,401 | A | 1/1976 | Shore et al. | |
| 7,602,933 | B2 | 10/2009 | Cartwright et al. | |
| 9,094,756 | B2 | 7/2015 | Stiehl et al. | |
| 9,805,590 | B2 * | 10/2017 | Shennib | G08C 17/02 |
| 2009/0123010 | A1 * | 5/2009 | Cano | H04R 1/1016 381/318 |
| 2015/0036835 | A1 * | 2/2015 | Chen | H04R 1/1041 381/74 |
| 2015/0139474 | A1 * | 5/2015 | Henry | H04R 1/1016 381/380 |
| 2015/0181330 | A1 * | 6/2015 | Rogers | H04R 1/1016 381/67 |

FOREIGN PATENT DOCUMENTS

| | | | |
|---|---|---|---|
| EP | 1 594 340 | A1 | 11/2005 |
| EP | 2 192 789 | A2 | 6/2010 |
| WO | 02/078392 | A2 | 10/2002 |
| WO | 2006/094502 | A1 | 9/2006 |
| WO | 2014/146702 | A1 | 9/2014 |

* cited by examiner

*Primary Examiner* — Melur Ramakrishnaiah
(74) *Attorney, Agent, or Firm* — Sughrue Mion, PLLC

(57) ABSTRACT

A hearing aid (1) comprises a flexible ear tip (9) for an ear piece (8) adapted for insertion into the ear canal of a user. The ear piece comprises a shroud having a generally ball-shaped hollow bulb made of soft resilient material, featuring a mid zone that is adapted for being softer to compression by the contact with ear canal wall than is the case with the end zones. The invention further provides an ear piece, an ear plug, and a component for a communications device.

20 Claims, 6 Drawing Sheets

FLEXIBLE EAR TIP FOR A HEARING AID

The present invention relates to an ear tip for an ear piece. The invention more particularly relates to an ear tip for a hearing aid. The invention further relates to a hearing aid with an ear plug with a flexible ear tip. The invention also relates to a communications device comprising an ear tip. The invention, more specifically, relates to a flexible ear tip for an In-the-Ear style hearing aid, for a Receiver-In-The-Ear style hearing aid, for a Behind-The-Ear (BTE) style hearing aid, or for a communications device.

BACKGROUND OF THE INVENTION

1. Field of the Invention

Within the context of the present disclosure an ear piece is understood as a plug or a similar structure suitable for insertion into a human ear and adapted for conveying acoustic power into the ear canal and for shielding the ear canal against sound from the surroundings. The acoustic power is typically derived from an electro-acoustic transducer, which may be arranged in the ear piece or spaced from the ear piece. The acoustic signal may be for the purpose of enhancing hearing, for communication or for amusement, e.g. for playing music etc.

Within the context of the present disclosure a hearing aid can be understood as a small, battery-powered, microelectronic device designed to be worn behind or in the human ear by a hearing-impaired user. A hearing aid comprises one or more microphones, a battery, a microelectronic circuit comprising a signal processor adapted to provide amplification tailored to meet the needs of the user, and an acoustic output transducer (in the hearing aid parlance often referred to as the receiver). The signal processor is preferably a digital signal processor. The hearing aid is enclosed in a casing suitable for fitting behind or in a human ear.

Hearing aids are sometimes classified to styles, notably BTE (Behind-The-Ear) for a hearing aid having electronics and speaker in a capsule fitting behind the ear and with a sound tube guiding the acoustic power to an ear piece, RITE (Receiver-In-The-Ear) for a hearing aid having electronics in a capsule fitting behind the ear, which is connected by a cable to an ear piece housing the output transducer, and ITE (In-The-Ear) for an integrated capsule fitting in the ear, such as in the concha or the canal. Either of these styles of hearing aids need some kind of ear tip for retaining the sound output opening correctly in the mouth of the ear canal.

Prior to use, the hearing aid is adjusted by a hearing aid fitter according to a prescription. The prescription is based on a hearing test, the result of which is expressed in an audiogram depicting the performance of the hearing-impaired user's unaided hearing. The prescription is developed to reach a setting where the hearing aid will alleviate a hearing loss by amplifying sound at frequencies in those parts of the audible frequency range where the user suffers a hearing deficit.

The acoustic output is produced by the output transducer and discharged into the ear canal through a conduit or an opening. The ear tip serves to maintain the conduit in position so as to prevent it from becoming dislodged, and to prevent the opening from being blocked by getting in contact with the walls in the ear canal. The ear tip may feature particular measures at the sound output, e.g. grids or a convoluted shape, serving to trap or block ingress of ear wax and humidity into the internals of the transducer, while keeping open the acoustic conduit to the extent possible.

The ear tip should further provide acoustic insulation between the inner part of the ear canal and the surroundings. However, for various reasons (bypass for enabling listening to un-amplified sound, pressure equalization, humidity control and general user comfort) a vent may be included, normally in the form of a passage deliberately incorporated in the plug. Ideally the vent should be carefully calibrated to the specific user's needs. A vent inevitably creates an acoustic leak, with the attendant risk of loss of amplified sound power and of amplified sound looping back to the microphone of the hearing aid, where it may be further amplified, potentially leading to an unstable feedback situation.

Users with a mild hearing loss and a correspondingly low gain setting, may favor a large vent to relieve the pressure build-up by own-voice speaking and to enable them to listen to the direct sound, which is useful if they retain good hearing acuity in part of the frequency range. Users with a profound hearing loss and correspondingly a high gain setting may favor a small vent, or maybe a closed one, to avoid unstable feedback and to avoid loss of sound power, and as any problems with excessive own-voice sound levels can, in case of a high gain setting, be handled satisfactorily by appropriate automatic gain adjustments.

As the vent is normally fixed once the ear plug has been made, a design choice regarding the length and lumen of the passage has to be made for the specific user to strike the optimal balance between these considerations. State-of-the-art hearing aids will then be adjusted taking into consideration the specific vent size and its implications on feedback gain limit, loss of sound power, leakage of sound to bystanders, and mixing direct sound with amplified sound.

2. The Prior Art

WO-A1-2006094502 discloses an earplug for a hearing aid comprising a main body part having a sound output opening. The earplug also has a collar, adapted to engage the wall of an ear canal and surrounding the main body part.

U.S. Pat. No. 3,935,401 provides an earpiece having a tubular hub with a flange on an end of the hub about a central passage, comprising radiating ribs which are mutually separated by radiating slots or by webs.

EP-A1-1594340 provides a flexible ear mould fitting comprising a base and a sidewall that is attached to the base and has an edge that extends substantially from the base to an opening of the earpiece.

U.S. Pat. No. 9,094,756 provides an ear piece including a compliant element operative to be inserted in the user's ear such that the compliant element deforms to retain the ear piece in the user's ear. The compliant element may include an outer portion folded over the ear piece housing.

U.S. Pat. No. 7,602,933 provides an ear piece device comprising a generally cone-shaped article made of pliable material dimensioned for fitting the ear canal of a user. A canal may extend through the ear piece to provide for communication between a person's inner ear and an environment outside the person's ear. The ear piece has a plurality of fold lines provided to facilitate the reversible collapsing of the cone into a star-like configuration when sufficient outside pressure is applied thereto.

WO-A2-02078392 provides a method of making a hearing aid housing with a shell, which is customized to an ear canal and further provided with a tightening contour, which at least partially encircles the shell.

WO-A1-2014146702 provides a hearing aid comprising a behind-the-ear part, an ear canal part and a cable. The cable is attached to a side wall of the ear canal part and is extending from this side wall in an angle to the axis between 20-70 degrees. The lateral end of the ear canal part may abut the outer ear, at the tragus part, while the cable abuts the outer ear at the concha, the tragus or the helix. This achieves a very stable positioning of the ear canal part, and prevents lateral migration of the ear canal part during chewing or talking.

EP-A2-2192789 provides an earpiece having a cap portion that has cutting portions formed in a direction of a through hole of a main unit. The cutting portions of the earpiece make through holes in the cap portion.

The human ear canal (the external auditory meatus) extends from the aperture (opening) of the ear canal to the tympanic membrane (eardrum). From the medial end, near the eardrum, it gradually flares out towards the lateral outer meatus. As seen from above it is slightly S-shaped. The cross-section is oval. Part of the wall is subject to movements linked to movements of the jaw bone. However, there is wide variability in size and shape among individuals.

Within the field of ear pieces it is standard practice to provide a selection of sizes and, to a lesser extent, shapes. Non-customized pieces are generally referred to as instant-fit.

For obtaining a close fit it is also a standard practice to provide a customized shape (custom fit) based on an impression of an individual ear canal. Providing a custom fit ear piece necessarily requires a more complicated process than providing an instant-fit ear piece. Even so, a custom fit ear plug may not answer all problems, as the ear canal is not a fixed structure.

The inventor has found that instant-fit plugs may perform less effectively than might have been expected. The tricky shapes of the ear canals, e.g. with twists or a more or less pronounced oval shape, make them inherently difficult to seal off by a circular plug shape. A radially protruding skirt on a plug may, when compressed by the ear canal walls, tend to form irregular pleats or folds, bound to establish air leaks, and may, on withdrawal, tend to fold over backwards, causing discomfort during the withdrawal and compelling the user to straighten the skirt before renewed insertion.

Uncontrolled leaks are bound to cause problems e.g. with feedback, loss of sound power, poor mixing of amplified sound with direct sound etc.

Furnishing a skirt with slits or dividing it up into radial ribs may make it able to cope with a wide range of ear canal sizes, however, slits or spaces between ribs are bound to leave open spaces voiding the acoustic seal. Further, folds, ribs and edges may not be preferred due to risk of creating sensations of itching or tickling. This can be annoying, keeping in mind that the wall of the ear canal moves with the jawbone, thus working on any object inserted in the ear canal.

The S-shape of the ear canal may cause the tip of an ear piece to end up in a slanted orientation where a sound output opening may be obscured or where a protruding flange seal does not seal properly against the ear canal wall. An ear piece with a protruding flange may end up in the ear canal in a state where part of the flange folds, leaving bypass openings.

SUMMARY OF THE INVENTION

The invention, in a first aspect, provides an ear tip as recited in claim 1.

Here the terms medial and lateral refer to the orientation of the ear tip when inserted into the human ear, i.e. medial is the direction towards the median plane of the head, viz. towards the tympanic membrane, while lateral is the direction away from the median plane of the head. The softer properties of the ear tip mid zone can be achieved by appropriate structural design, such as tapering wall thicknesses, arranging pleats or bellows shapes or by selecting materials with suitable softness.

Making the mid zone softer in compression means the ear tip is very soft in the pressure exerted on the ear canal wall and therefore comfortable for the user during insertion and during regular wear. The medial zone and the lateral zone (jointly referred to as the end zones) are less soft to compression than is the case with the mid zone. However, as the bulb is generally ball-shaped, the end zones will have a smaller diameter and therefore not in need of being compressed as much as is the case with the mid zone, and therefore not likely to exert any uncomfortable pressure on the ear canal. The somewhat more sturdy structures of the end zones make the ear tip easy in insertion, an observation borne out by a panel of test persons who reported a sensation of the ear tip tending to comfortably navigating its way through the twists and bends of the ear canal. Test persons further report that the novel ear tip achieves a firm seat in the ear canal with no propensity to dislodge during wear.

The bulb may seal against the ear canal wall at the medial zone, the mid zone, the lateral zone, or any combination thereof.

An embodiment provides the mid zone with pleats extending generally parallel to the axis. This endows the bulb with the capability of accepting substantial compression of the mid zone.

Making the pleats deepest at the mid zone and then tapering off towards both end zones calibrates the resilience to compression in order that it will not exhibit any abrupt changes.

Providing webs across the valleys in the pleats seals off the valleys against axial passage of air for optimal acoustic insulation.

In an embodiment, the bulb comprises a circumferential low ridge at the mid zone for sealing against the ear canal wall. This establishes a circumferential sealing zone, which supplements the sealing effect by the end zones. Having three circumferential sealing zones is important as the human ear canal normally exhibits bends, causing some of the sealing areas to be oriented obliquely to the ear piece axis, and therefore prone to introduce leakages against the canal wall.

In an embodiment, the bulb is reinforced around the lateral opening. The reinforcement, which may be implemented by bulking up the wall thickness, by adding struts, or by other structural means, makes the lateral zone less pliable in compression. This ensures that the lateral zone has suitable resilience, even if this part has an opening, i.e. it is not anchored to, or buttressed by, any core structure, for being free to expand axially, and for leaving a passage for air. The reinforcement also prevents the shroud from bending over backwards on withdrawal of the ear tip from the ear canal.

Further advantageous features appear from the dependent claims.

The invention, in a second aspect, provides an ear plug as recited in claim 14.

The invention, in a third aspect, provides a hearing aid as recited in claim 15.

The invention, in a fourth aspect, provides a component for a communications device as recited in claim 16.

Still other objects of the present invention will become apparent to those skilled in the art from the following description wherein the invention will be explained in greater detail.

BRIEF DESCRIPTION OF THE DRAWINGS

By way of example, there is shown and described embodiments of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
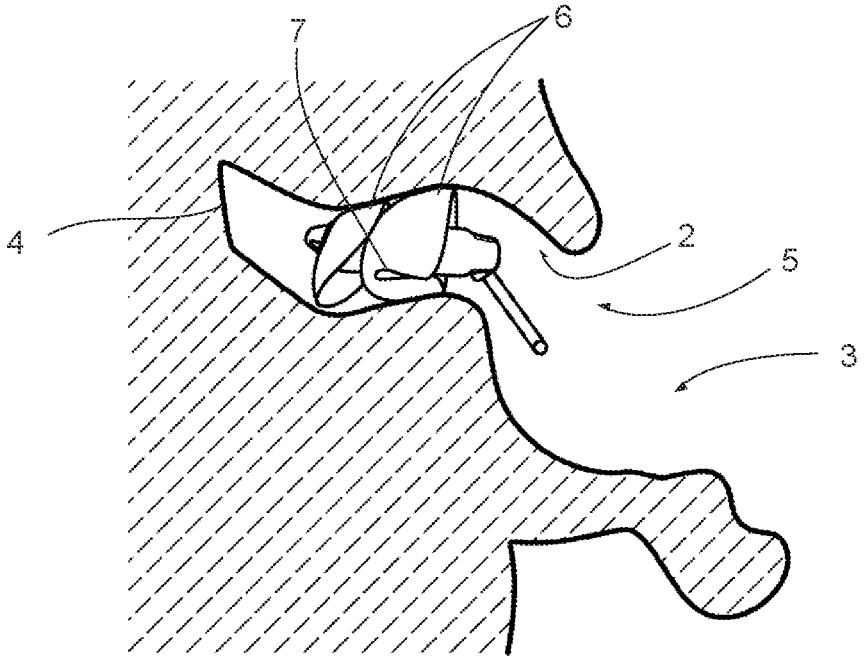
FIG. 1 illustrates a horizontal section of part of a human head, through an ear canal and with an ear piece according to the prior art.

Reference is first made to FIG. 1, which illustrates a horizontal section of part of a human head, through an ear canal and with an ear piece 5 according to a generic prior art. The ear piece illustrated comprises a core with two annular cones 6. The ear canal 2 has an S-shape between the outer ear 3 and the tympanic membrane 4. FIG. 1 illustrates a situation where a bend in the S-shape causes the inner shroud to be pressed hard against one side of the ear canal while leaving a lack of contact to the ear canal wall to the other side. The outer shroud is compressed so much that the cone folds, at 7. A pressure point, perhaps at an edge of a cone, is likely to cause discomfort to the user, e.g. during chewing. A lack of contact pressure or a fold is likely to create a leak.

Ear canals come in many sizes and shapes. It is standard practice to supply instant-fit ear piece in a selection of sizes. Fits may end up differently; however, and the inventors have found that problems are widespread.

Figure 2:
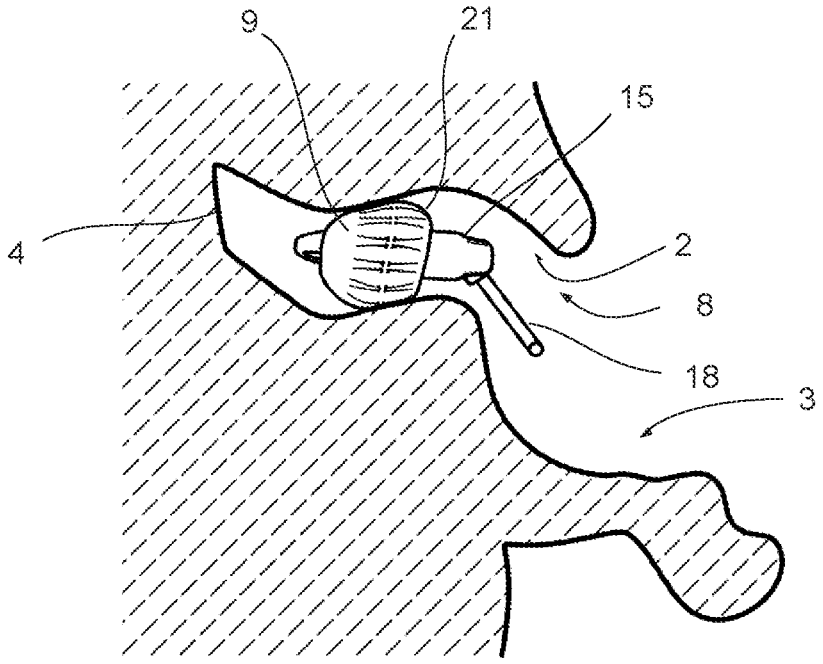
FIG. 2 illustrates a horizontal section of part of a human head, through an ear canal and with an ear piece according to an embodiment of the invention.

Reference is made to FIG. 2, which illustrates a horizontal section of part of a human head, through an ear canal and with an ear piece 8 according to an embodiment of the invention. The ear piece comprises ear tip 9 and core fixture or hub 15 and is connected to a hearing aid (not shown) by a cable 18. The ear tip 9 has shroud 21. The shroud has a bulbous shape without sharp edges, and softly adapts to the ear canal.

Figure 3:
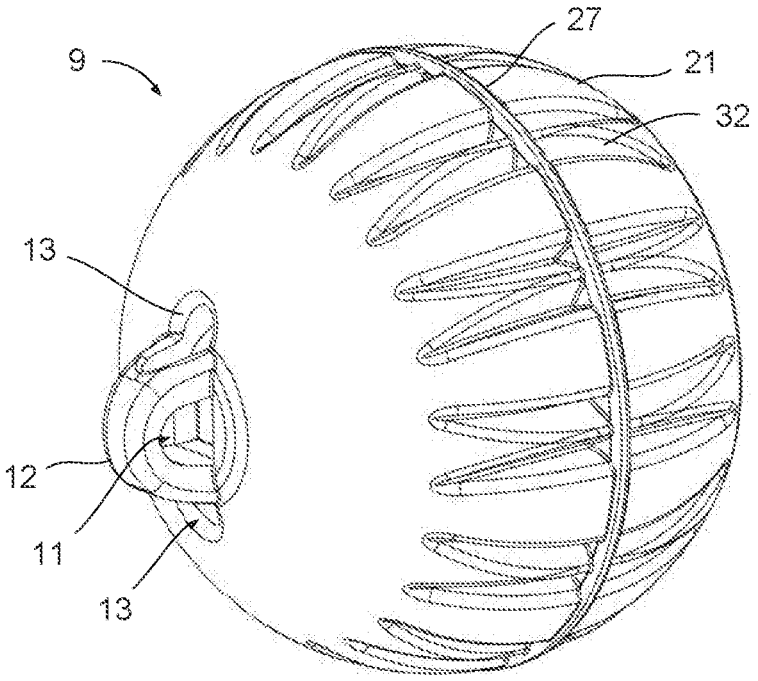
FIG. 3 illustrates an ear tip according to a first embodiment of the invention showing the side and the top.

Reference is next made to FIG. 3, which illustrates the ear tip 9 according to the first embodiment of the invention showing the side and the end intended to be pointed medially in the ear canal, which is here loosely referred to as the top end. FIG. 3 depicts the shroud 21, waistband 27, sound output opening 11, lug 12, and vents 13. The shroud is generally ball-like with pleats 32 in a band extending to both sides of the waistband 27.

Figure 4:
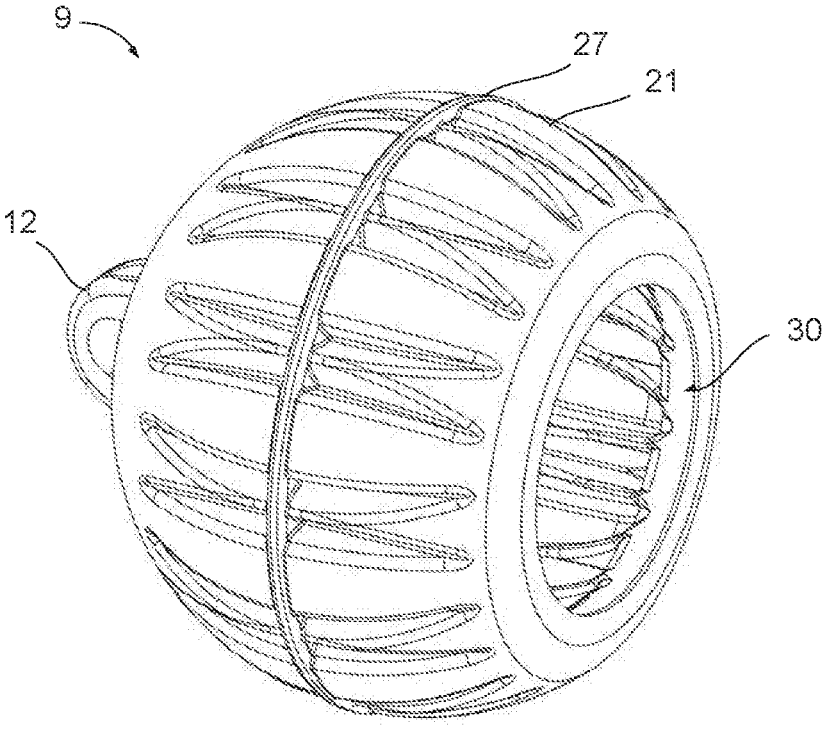
FIG. 4 illustrates the ear tip as in FIG. 3, showing the side and the bottom.

Reference is made to FIG. 4, which again illustrates the ear tip 9 according to the first embodiment of the invention, here showing the side and the end intended to be pointed laterally when in the ear canal, which is here loosely referred to as the bottom end. FIG. 4 depicts lug 12, shroud 21, waistband 27, and bulb lower opening 30.

Figure 5:
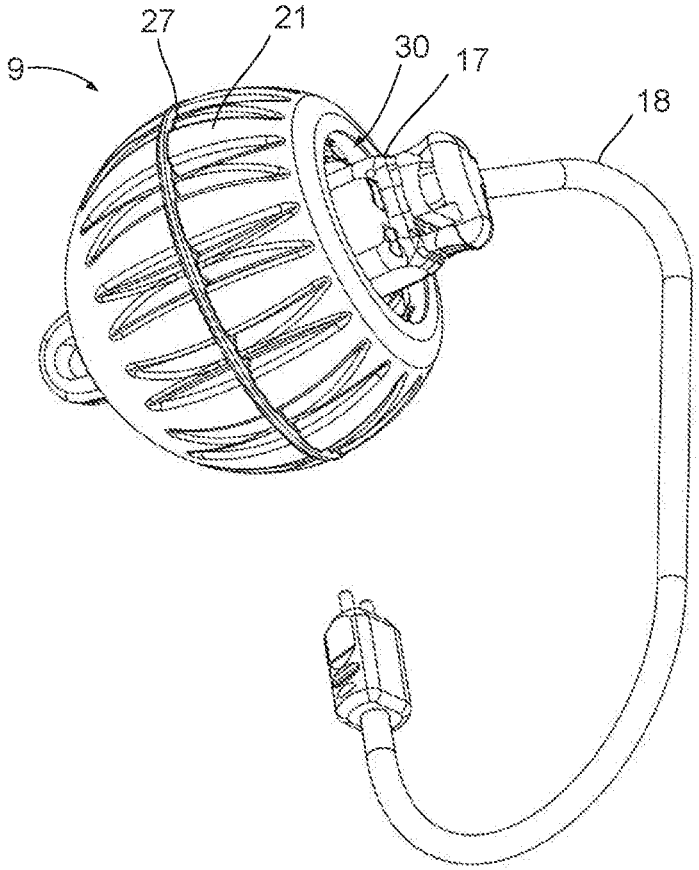
FIG. 5 illustrates an ear piece according to an embodiment of the invention, with a cable connected.

Reference is then made to FIG. 5, which illustrates the ear tip 9 according to the first embodiment of the invention, with the cable 18. FIG. 5 again shows the shroud 21, waistband 27, and bulb lower opening 30, and additionally part of the speaker 17.

Figure 6:
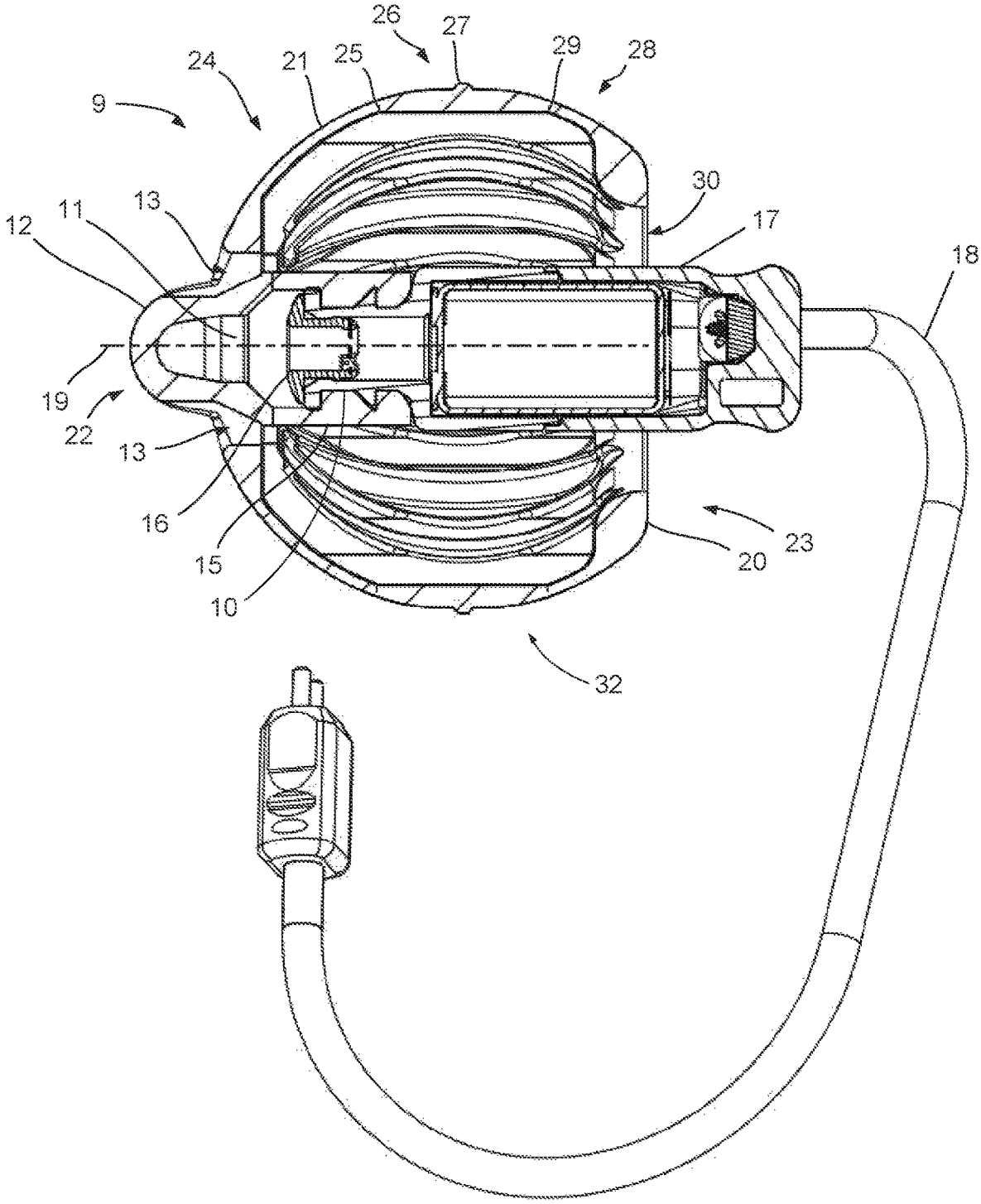
FIG. 6 is a plan section of the ear piece through the axis, and illustrating also the cable.

Reference is now made to FIG. 6, which is a plan section of the ear piece through the axis 19. FIG. 6 depicts the ear tip 9 with shroud 21, waistband 27, sound output opening 11, lug 12, vents 13, speaker 17, cable 18, and bulb lower opening 30.

The sound output opening 11 is bridged by lug 12, which opens to opposing sides and spaces the bridge side openings from the ear canal wall. The vents 13 open up to the bulb inside and from there through lower opening 30 to the surroundings. The vents are spaced from the bridge side openings to avoid any risk of a wax build-up growing to establishing a common blockade of the openings, which might create an acoustic short-circuit.

For the ear tip, axis 19 generally constitutes an axis of rotational symmetry.

The section in FIG. 6 further depicts some inner details, such as core fixture or stem 15, wax guard 16, socket 10 adapted for the attachment of a sound conduit from speaker 17 and for holding the wax guard, ear tip medial end 22, and ear tip lateral end 23.

The material used for the ear tip is a softly resilient silicone rubber with a hardness in the range 10-90 Shore A, e.g. in the range 30-50 Shore A.

In a variation of this embodiment the bulb stem portion comprises a silicone rubber material with a hardness in the range 70-90 Shore A, while the bulb shroud portion comprises a silicone rubber material with a hardness in the range 10-40 Shore A.

The generally spherical ear tip comprises various zones that are perhaps easiest designated using the nomenclature pertaining to the Earth globe. The lug 12 (really the medial point, i.e. the point to lead the ear tip when being pressed into the ear canal) marks the North Pole. Next comes the northern tempered zone 24, the tropic zone 26, and the southern tempered zone 28, while the part further south is open. The northern tempered zone is demarcated from the tropic zone by bulb upper parallel (Tropic of Cancer) 25. The southern tempered zone is demarcated from the tropic zone by the bulb lower parallel (Tropic of Capricorn) 29.

On the outside, the shroud is smooth and spherical in the northern tempered zone and in the southern tempered zone, whereas it is has pleats in the tropical zone. The pleats run parallel to the axis and reach their maximum depth at the equator, then tapering away north and south to vanish at the upper and lower parallels. The shroud is softest at the tropical zone, where the pleats permit it to yield softly, peripherally and radially, to external axial pressure. The shroud is unrestrained at the southern end, a structure which permits it to also expand axially under external pressure.

The northern tempered zone is resilient, though buttressed by the core fixture 15 at the north polar zone. At the southern parallel, the shroud is reinforced by the wall structure by a bead 20 on the inside. The reinforcement helps preserving the ball-shape, and prevents the shroud from folding over backwards by the friction against the ear canal wall during an operation of withdrawing the ear tip.

Figure 7:
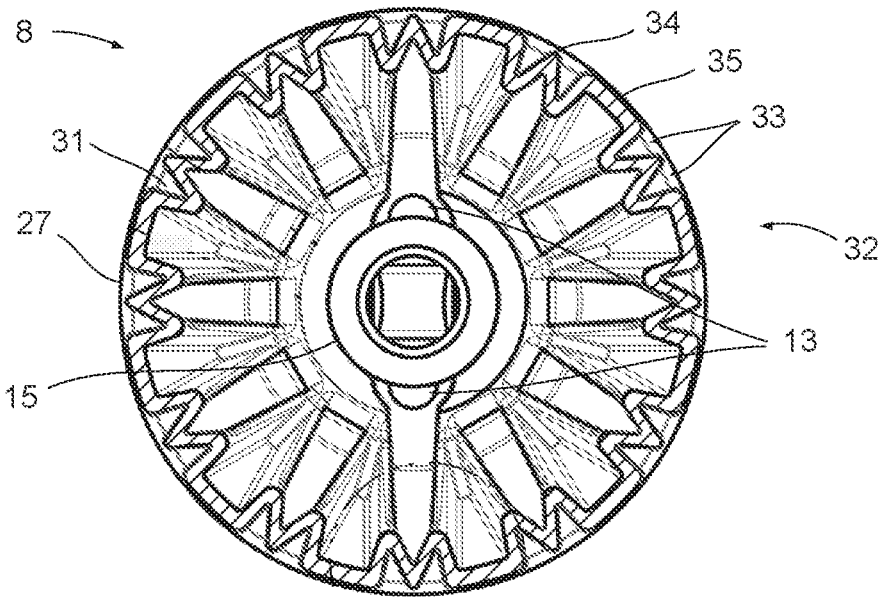
FIG. 7 is a plan section of the ear tip of FIG. 3, perpendicular to the axis, just below the equator and viewed from below.

Reference is then made to FIG. 7, which shows a plan section of the ear tip 8, perpendicular to the axis 19, just below the equator 27 and viewed from below.

FIG. 7 illustrates the pleats 32, which are laid out pairwise and comprise valleys 33, narrow ridges 34, and somewhat wider pleat outer faces 35 aligned with the circumference. FIG. 7 further shows vents 13, and core fixture 15. Equator exhibits a waistband 27, in the form of a slightly elevated rim. The rim is circular at the outside and spans the valleys by integral webs 31, which close off the valleys to longitudinal passage of air.

Ear canals can be estimated to range from 6-14 mm in diameter. The ear tip is estimated to cover a range of ear canal sizes down to a diameter of 60 or 80% of the rated full size diameter, depending on circumstances such as the particular shape of ear canal, personal sensitivity to pressure etc. Thus a selection of maybe 3 to 7 sizes, suitably staggered, will accommodate the users well.

Figure 8:
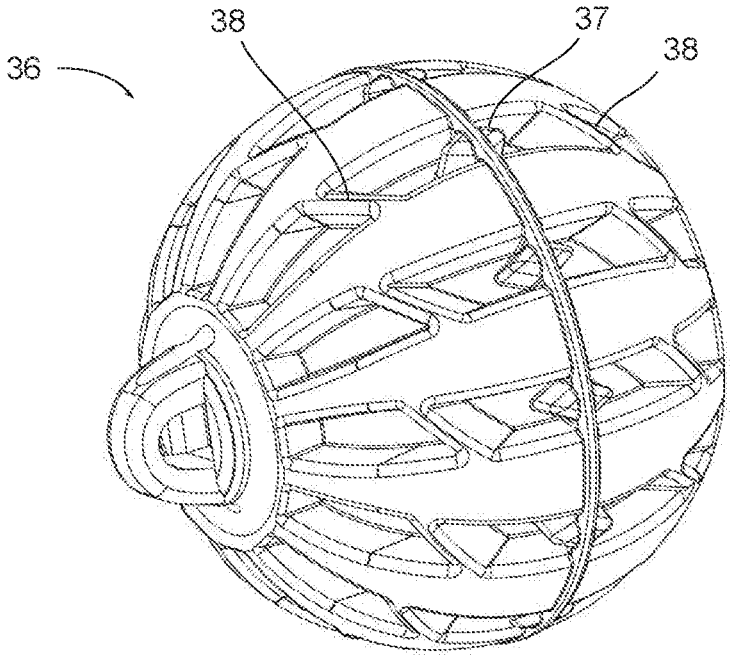
FIG. 8 illustrates an ear tip according to a second embodiment of the invention, showing the side and the top.

Reference is made to FIG. 8, which illustrates an ear tip 36 according to a second embodiment of the invention, in a view similar to the view in FIG. 3. This embodiment features pleats with wider and longer valleys than is the case with the first embodiment. The tempered zones are correspondingly shorter.

At the equator the valleys are bridged by webs, which expand into rhombic bosses 37 for supporting the waistband. To both sides of the equator there are slanted webs 38 bridging the valleys for sealing off the valleys to axial passage of air. Other details are similar to what has been explained pertaining to the first embodiment.

Figure 9:
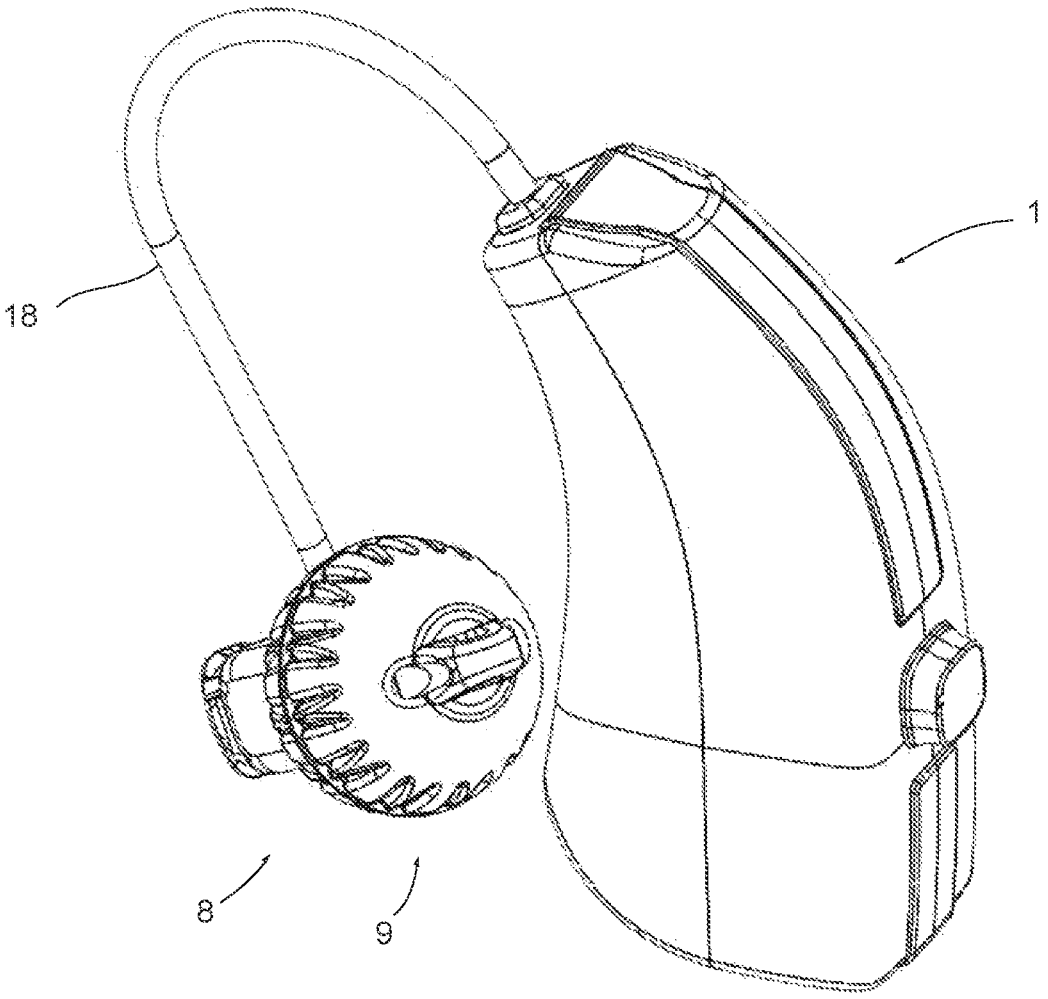
FIG. 9 illustrates a hearing aid comprising an ear piece.

References is last made to FIG. 9, which depicts a hearing aid 1 having an ear piece 8 with an ear tip 9, the ear piece being connected by cable 18 to the remaining portion of the hearing aid. The practical implementation will be obvious to those skilled in the art.

In variations, the ear piece is deployed in association with a headset for a telephone, a communications device or a music player. Implementations of the variations will be obvious to those skilled in the art.

We claim:

1. An ear piece adapted for insertion into the ear canal of a user, and to provide acoustic insulation between the inner part of the ear canal and the surroundings, the ear piece comprising an ear tip with a stem and a shroud, the stem defining a sound conduit with a sound output opening, and the shroud having a generally ball-shaped hollow bulb made of soft resilient material, the bulb having an axis generally along the intended direction of insertion into the ear canal, a sound output opening, a generally round first end zone with a smooth outer surface, a generally round second end zone with a smooth outer surface opposite the medial surface zone, and a mid zone intermediate the first end zone and the second end zone, wherein the mid zone is adapted by appropriate structural design for being softer to radial compression by the contact with ear canal wall than is the case with the first end zone and the second end zone.

2. The ear piece according to claim 1, wherein the adaptation of the mid zone by appropriate structural design comprises providing any one of tapering wall thicknesses, pleats or bellows shapes or selecting materials with suitable softness.

3. The ear piece according to claim 2, wherein the mid zone of said bulb is of a different material than the material of at least one of said first end zone and second end zone.

4. The ear piece according to claim 1, wherein the mid zone comprises a wall with pleats extending generally parallel to the axis.

5. The ear piece according to claim 4, wherein the pleats are deepest at the midpoint between the first end zone and the second end zone and gradually taper out adjacent the first end zone and the second end zone.

6. The ear piece according to claim 4, wherein the bulb comprises webs bridging the spaces between the valleys in the pleats for sealing against passage of air along the valleys.

7. The ear piece according to claim 1, wherein the bulb comprises a circumferential low ridge at the mid zone for sealing against the ear canal wall.

8. The ear piece according to claim 1, wherein the bulb second end zone defines a lower opening and wherein the bulb is structurally reinforced around the lower opening.

9. The ear piece according to claim 1, wherein the stem is adapted for the attachment of a sound conduit for a speaker.

10. The ear piece according to claim 1, wherein the bulb comprises a vent opening to the bulb interior adjacent the sound output opening.

11. The ear piece according to claim 1, wherein the bulb comprises a silicone rubber material with a hardness in the range 10-90 Shore A.

12. The ear piece according to claim 1, wherein the bulb comprises a silicone rubber material with a hardness in the range 30-50 Shore A.

13. The ear piece according to claim 1, wherein the bulb stem comprises a silicone rubber material with a hardness in the range 70-90 Shore A.

14. The ear piece according to claim 1, wherein the bulb shroud comprises a silicone rubber material with a hardness in the range 10-40 Shore A.

15. An ear plug comprising an ear piece according to claim 1, comprising a core structure and a speaker, wherein the core structure holds the speaker and is attached to the bulb adjacent to first end zone, and wherein the core structure is adapted to not restrain axial movement of the bulb lower zone.

16. A hearing aid comprising an ear piece according to claim 1.

17. A component for a communications device comprising an ear piece according to claim 1.

18. The ear piece according to claim 1, wherein at least a part of an outer surface of said mid zone is of a different surface configuration than the outer surfaces of the first and second end zones.

19. The ear piece according to claim 1, wherein an end of said second end zone remote from said mid zone defines an opening configured to surround but not contact a central member carrying sound for reproduction at said sound output opening, said central member comprising one of a sound tube or an electrical cable or component.

20. The ear piece according to claim 1, wherein said ear piece is configured for insertion into said ear canal by an insertion force exerted in said ear piece at a location further into said ear canal than said mid zone, whereby at least a part of a force inserting said mid zone into said ear canal is a pulling force.

* * * * *